US006697021B2

(12) United States Patent
Shi

(10) Patent No.: US 6,697,021 B2
(45) Date of Patent: Feb. 24, 2004

(54) DOUBLE F ANTENNA

(75) Inventor: Daliang Shi, San Diego, CA (US)

(73) Assignee: Microtune (San Diego), Inc., San Diego, CA (US)

( * ) Notice: Subject to any disclaimer, the term of this patent is extended or adjusted under 35 U.S.C. 154(b) by 0 days.

(21) Appl. No.: 10/047,653

(22) Filed: Jan. 14, 2002

(65) Prior Publication Data

US 2003/0132881 A1 Jul. 17, 2003

(51) Int. Cl.[7] ..... H01Q 1/24
(52) U.S. Cl. ..... 343/702; 343/700 MS
(58) Field of Search ..... 343/700 MS, 702, 343/846, 848, 829

(56) References Cited

U.S. PATENT DOCUMENTS

| | | | | |
|---|---|---|---|---|
| 6,034,636 A | * | 3/2000 | Saitoh | 343/700 MS |
| 6,061,024 A | | 5/2000 | McGirr et al. | 343/700 |
| 6,204,819 B1 | * | 3/2001 | Hayes et al. | 343/702 |
| 6,255,994 B1 | * | 7/2001 | Saito | 343/700 MS |
| 6,278,369 B2 | * | 8/2001 | Smith et al. | 340/572.7 |
| 6,295,030 B1 | | 9/2001 | Kozakai et al. | 343/700 |
| 6,295,462 B1 | * | 9/2001 | Kudoh | 455/562 |
| 6,417,817 B1 | * | 7/2002 | Pirila et al. | 343/841 |
| 6,473,042 B1 | * | 10/2002 | Fang et al. | 343/700 MS |
| 6,483,463 B2 | * | 11/2002 | Kadambi et al. | 343/700 MS |
| 2002/0126052 A1 | | 9/2002 | Boyle | 343/702 |
| 2002/0140612 A1 | | 10/2002 | Kadambi et al. | 343/702 |

FOREIGN PATENT DOCUMENTS

| | | | |
|---|---|---|---|
| EP | 1 189 304 A2 | 3/2002 | H01Q/9/04 |
| JP | 09 093030 A | 4/1997 | H01Q/9/30 |
| WO | WO 01/91236 A1 | 11/2001 | H01Q/9/04 |

* cited by examiner

*Primary Examiner*—Don Wong
*Assistant Examiner*—Shih-Chao Chen
(74) *Attorney, Agent, or Firm*—Baker Botts L.L.P.

(57) ABSTRACT

A double F antenna is disclosed. In one embodiment, an antenna, comprises a conductive member having a center between a first end and a second end of the member; a first port connected perpendicularly to the conductive member between the center and the first end; a second port connected perpendicularly to the conductive member between the center and the second end; and a ground port connected perpendicularly to the conductive member, wherein the ground port is connected to the center.

20 Claims, 7 Drawing Sheets

DOUBLE F ANTENNA

BACKGROUND OF THE INVENTION

1. Field of the Invention

The present invention relates generally to antennas, and more particularly to antennas used with wireless communication devices.

2. Description of the Related Art

Wireless devices typically include an antenna for transmitting and/or receiving wireless communications signals. Historically, monopole and dipole antennas have been employed in various radiotelephone applications, due to their simplicity, wideband response, broad radiation pattern, and low cost.

However, wireless communications devices are undergoing miniaturization and low cost. As a result, there is increasing interest in small antennas that can be utilized as internally-mounted antennas for wireless devices at minimum cost.

Conventional inverted-F antennas, by design, is a single port antenna. Most antennas for wireless devices are one-port antennas. When the device is sending or receiving, it uses the same port. With one-port antennas, the antenna connection must be switched between transmit and receive. To achieve high frequency switching a PIN diode switch is often used. A PIN diode switch is very expensive and has failure potential.

In addition, wireless devices may also incorporate Bluetooth wireless technology. Bluetooth technology provides a universal radio interface in the 2.45 GHz frequency band that enables portable electronic devices to connect and communicate wirelessly via short-range ad hoc networks. Accordingly, wireless devices incorporating these technologies may require additional antennas tuned for the particular frequencies Bluetooth.

SUMMARY OF THE INVENTION

A double F antenna is disclosed. In one embodiment, an antenna, comprises a conductive member having a center between a first end and a second end of the member; a first port connected perpendicularly to the conductive member between the center and the first end; a second port connected perpendicularly to the conductive member between the center and the second end; and a ground port connected perpendicularly to the conductive member, wherein the ground port is connected to the center.

BRIEF DESCRIPTION OF THE DRAWINGS

A better understanding of the present invention can be obtained from the following detailed description in conjunction with the following drawings, in which.

DETAILED DESCRIPTION

In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the invention.

Figure 1:
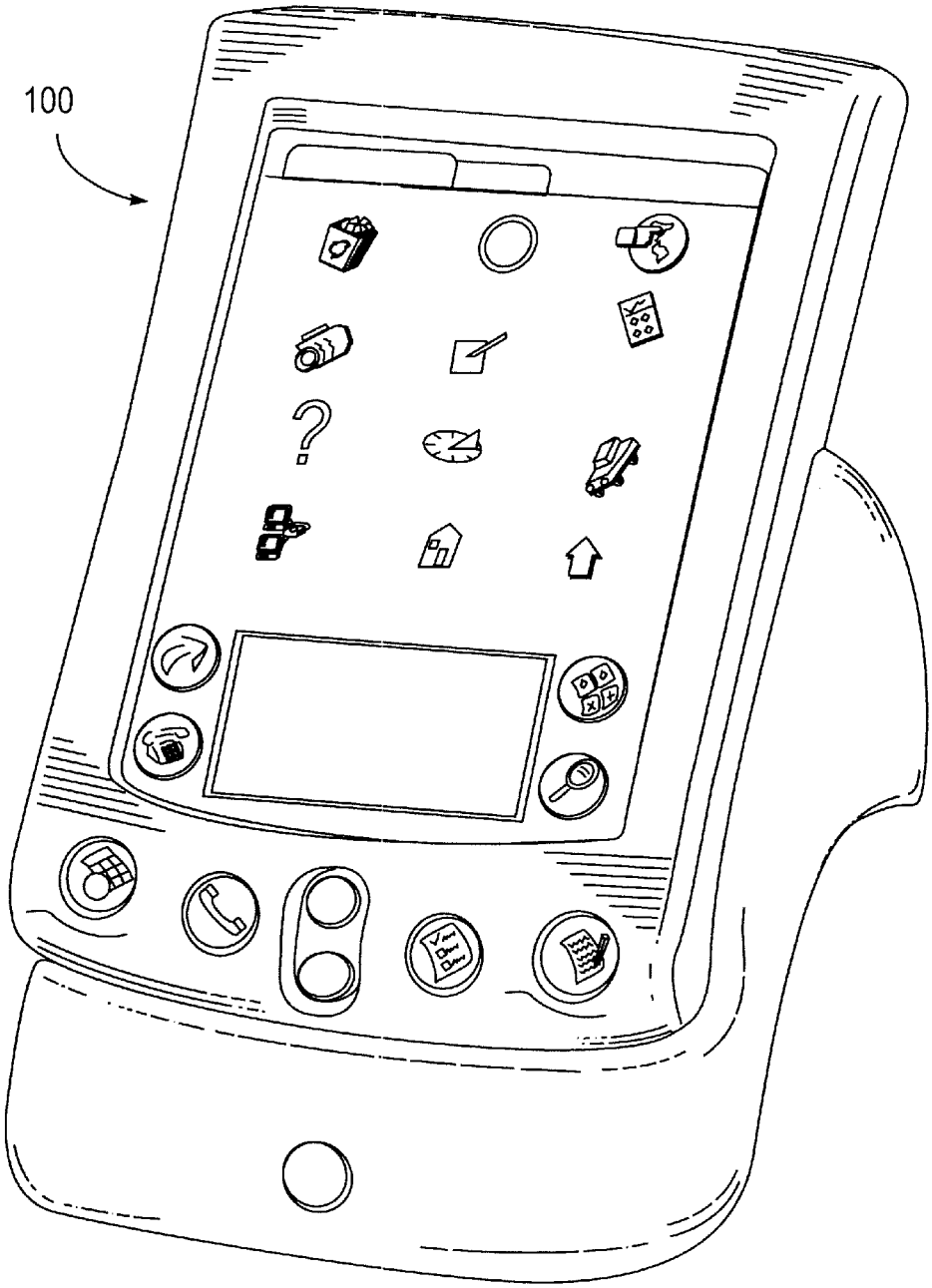
FIG. 1 illustrates an exemplary wireless device (PDA) within which an antenna according to the present invention may be incorporated.

Referring now to FIG. 1, an exemplary wireless device 100 is illustrated within which a double F antenna according to the present invention may be incorporated. Although FIG. 1 illustrates a Person Digital Assistant (PDA), the present double F antenna, may be used on any wireless or Bluetooth enabled device, such as a computer keyboard, mouse, digital camera or cordless phone.

Figure 2:
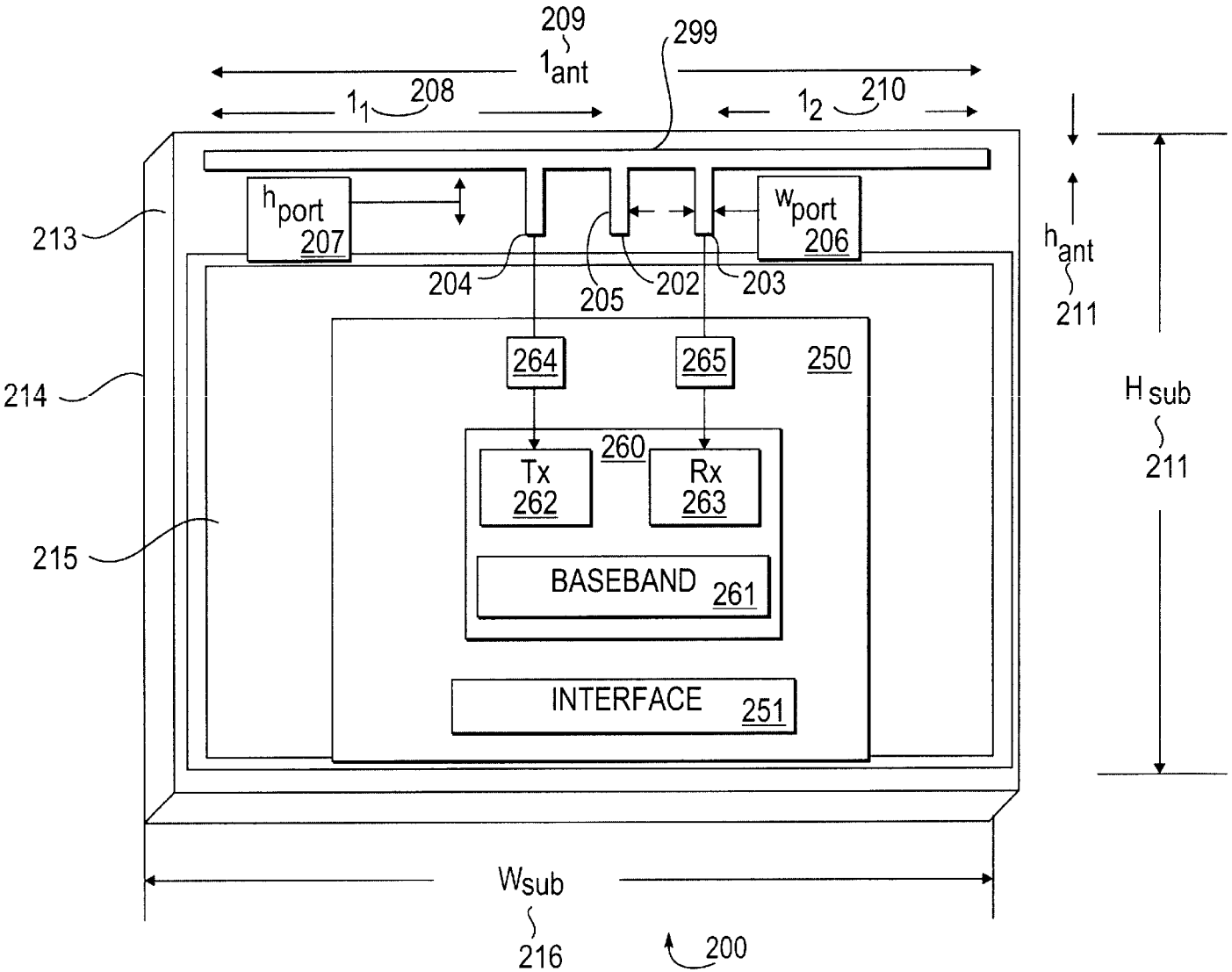
FIG. 2 schematically illustrates a double F antenna according to an embodiment of the present invention.

A double F antenna according to one embodiment of the present invention is within device 100. FIG. 2 schematically illustrates an integrated circuit 200 having double F antenna 299 with supporting circuitry 250 according to one embodiment of the present invention. Antenna 299 has two ports, Transmit Port 204 and Receive Port 203. Antenna 299 is symmetrical in one embodiment; although non-symmetrical embodiments are also considered to be within the scope of the present invention. In one embodiment, the height ($h_{port}$ 207) of ports 203, 204 are 5 mm, and the width ($w_{port}$ 206) of ports 203, 204 are 1.6 mm. Antenna 299 also includes a grounding port and via 202 which connects ground plane 214 to antenna 299. The width ($w_{via}$ 205) of grounding port and via 202 may be 1 millimeter in one embodiment. The length ($l_{ant}$ 209) of antenna 299 can be 42 mm. The height ($h_{ant}$ 211) can be 1 mm in one embodiment. The length ($l_1$ 208) of one end of antenna 299 to ground port and via 202 can be 20.5 mm and the length ($l_2$ 210) of one end of antenna 299 to port 203 can be 16.8 mm.

In one embodiment, antenna 299 is made from one ounce copper, with conductivity 58,000,000 and permeability 1, although other conductive metals are considered to be within the scope of the present invention. Because antenna 299 is symmetrical either port 203, or 204 may be configured to transmit or receive via the radiative portion of antenna 299. Substrate 213 may be FR4 material having relative permittivity of 4.5 and electric loss tangent of 0.03 or other material with similar dielectric properties. In one embodiment, the height of substrate 213 can be 36 mm. A top side ground plane 215 is also included in circuit 200.

FIG. 2 also illustrates supporting circuitry 250 for use with antenna 299. Circuitry 250 is connected to antenna 299 via ports 203, 204. Matching circuits 264 and 265 match the impedance of antenna 299 with supporting circuitry 250. Transmit port 204 is connected to transceiver 260 via matching circuit 264. Receive port 203 is connected to transceiver 260 via matching circuit 265.

Transceiver 260 includes a transmitter 262 for providing signals for broadcast on antenna 299. A receiver 263 receives signals from antenna 299, such as signals in the 2.4 GHz frequency range, using Bluetooth technology. Transmit and receive signals may be (de)modulated or mixed at baseband processor 261. Circuit 200 communicates with the rest of device 100 via interface 251 which may be a universal serial bus (USB), serial port or Joint Test Action Group (JTAG) connector. Interface 251 is connected to transceiver 260. Although circuitry 250 is shown to be a simplified transceiver scheme, other configurations are also considered to be within the spirit and scope of the present invention.

Figure 3:
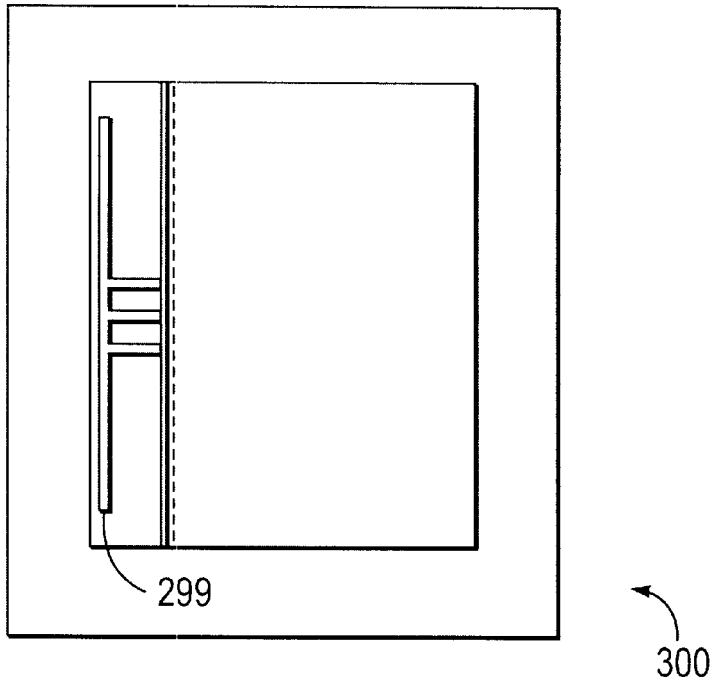
FIG. 3 schematically illustrates a top view of a double F antenna according to an embodiment of the present invention.
Figure 4:
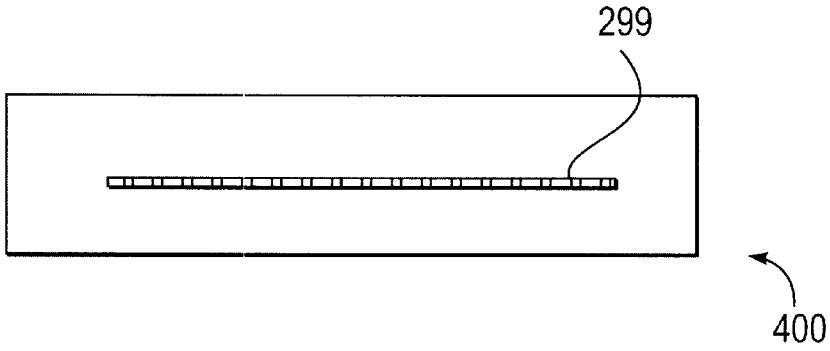
FIG. 4 schematically illustrates a front view of a double F antenna according to an embodiment of the present invention.
Figure 5:
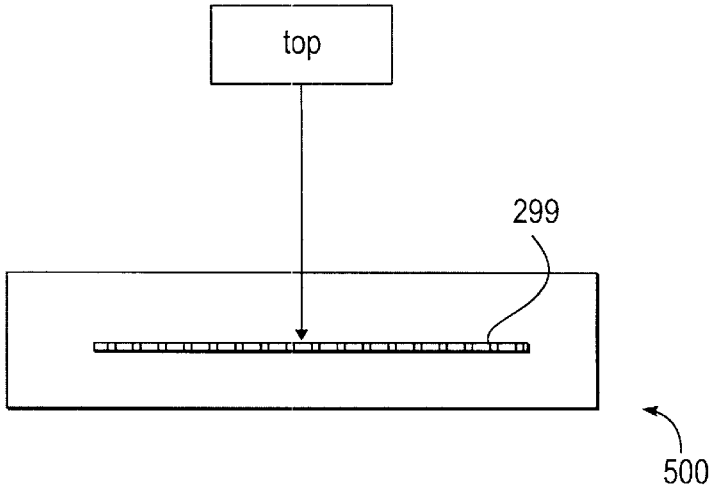
FIG. 5 schematically illustrates a side view of a double F antenna according to an embodiment of the present invention.
Figure 6:
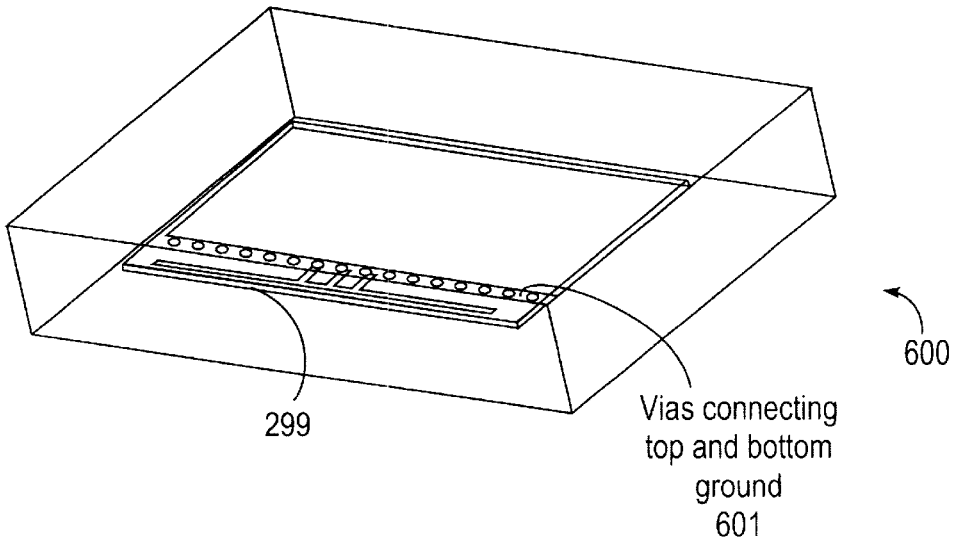
FIG. 6 schematically illustrates a front angle view of a double F antenna according to an embodiment of the present invention.
Figure 7:
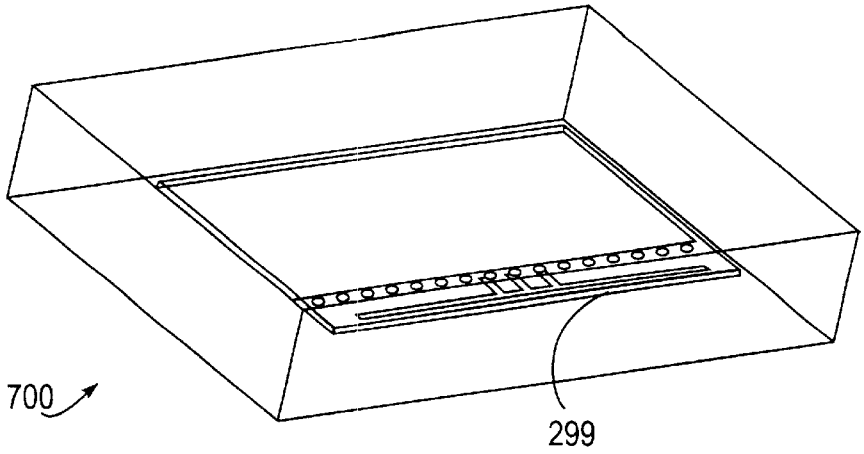
FIG. 7 schematically illustrates a back angle view of a double F antenna according to an embodiment of the present invention.

FIG. 3 schematically illustrates a top view 300 of antenna 299 (support circuitry 250 is not shown). FIG. 4 schematically illustrates a front view 400 of antenna 299 (support circuitry 250 is not shown). FIG. 5 schematically illustrates a side view 500 of antenna 299 (support circuitry 250 is not shown). FIG. 6 schematically illustrates a front-angle view 600 of antenna 299 (support circuitry 250 is not shown). Also shown in FIG. 6 are vias 601 for connecting bottom side ground plane 214 with top side ground plane 215. FIG. 7 schematically illustrates a back-angle view 700 of antenna 299 (support circuitry 250 is not shown).

Figure 8:
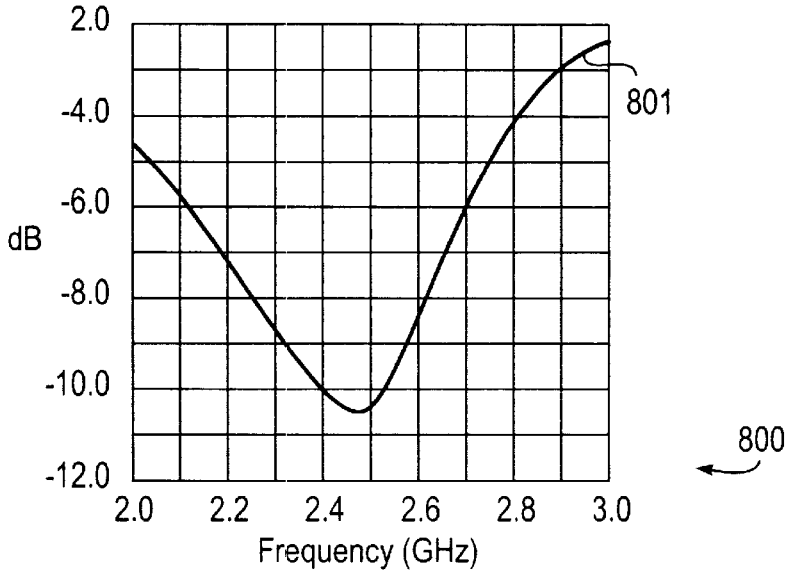
FIG. 8 illustrates the frequency response of a double F antenna when receiving communication signals according to an embodiment of the present invention.

FIG. 8 illustrates a graph 800 displaying the frequency response 801 of antenna 299 when receiving signals. At 2.45 GHz, antenna 299 shows approximately −10.5 dB gain. The shape of graph 800 indicates that energy from other devices broadcasting at frequencies other than 2.45 GHZ will be rejected by antenna 299. Although, the present example was that of a Bluetooth device operating at 2.45 GHz, antenna 299 can be tuned to provide a similar frequency response as shown in FIG. 8, for other operational frequencies.

Figure 9:
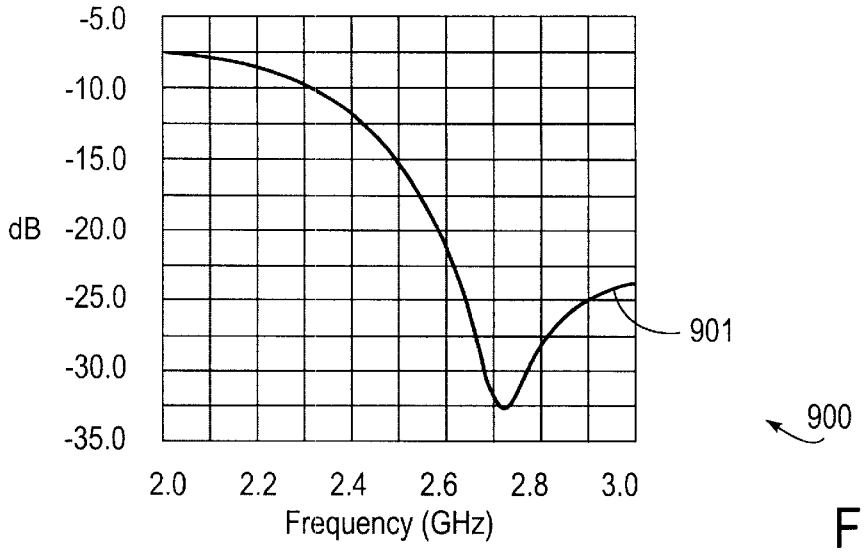
FIG. 9 illustrates the frequency response of a double F antenna when transmitting communication signals according to an embodiment of the present invention.

FIG. 9 illustrates a graph 900 displaying the frequency response 901 of antenna 299 when transmitting signals. A high performance antenna has little reflection of the energy transmitted or received through it, as is evidenced by the shape of graph 800. In the present example at 2.45 GHZ, the gain of antenna 299 is approximately −15 dBm, which is only approximately 10% loss of power passed through transmit port 204. Although, the present example was that of a Bluetooth device operating at 2.45 GHz, antenna 299 can be tuned to provide a similar frequency response as shown in FIG. 9, for other operational frequencies.

Figure 10:
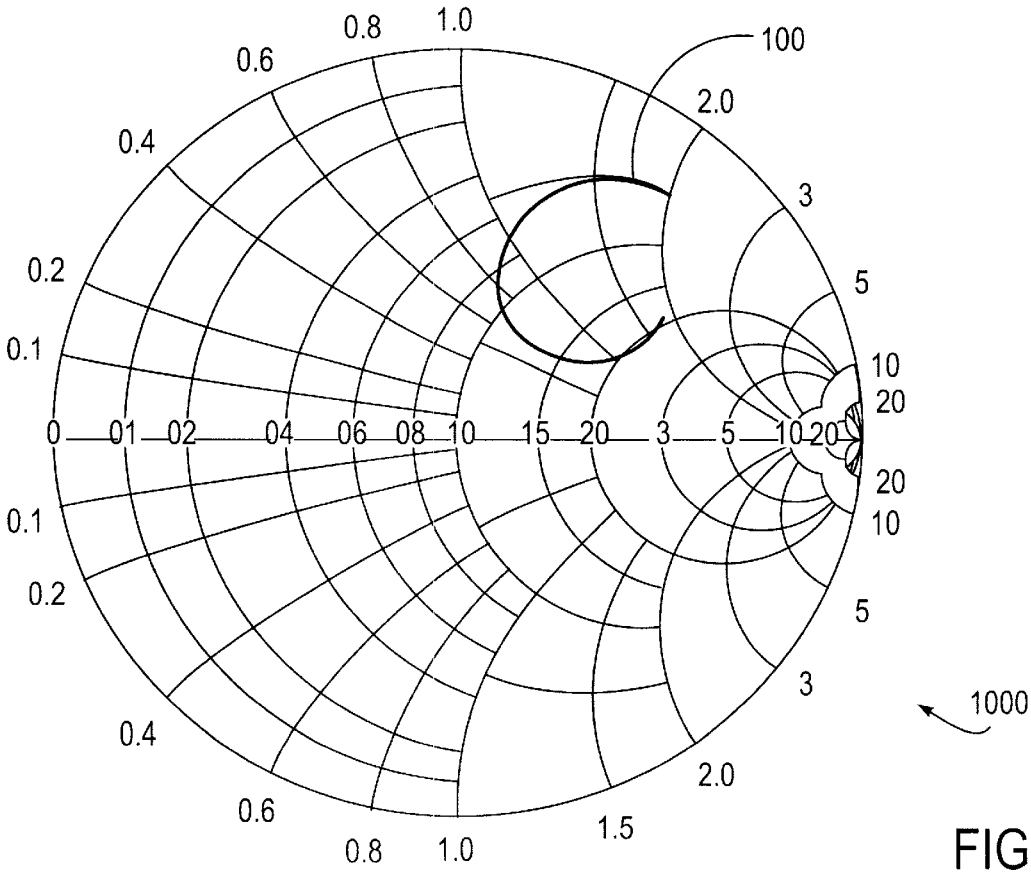
FIG. 10 is a Smith chart illustrating impedance characteristics of a double F antenna according to an embodiment of the present invention.

FIG. 10 is a Smith chart 1000 illustrating the impedance characteristics of antenna 299 according to one embodiment of the present invention. According to graph 1001, a 4.7 pF capacitor may be used to perfectly match the input impedance of antenna 299 to 50 ohms. This capacitor may be placed within matching circuits 264, 265.

Figure 11:
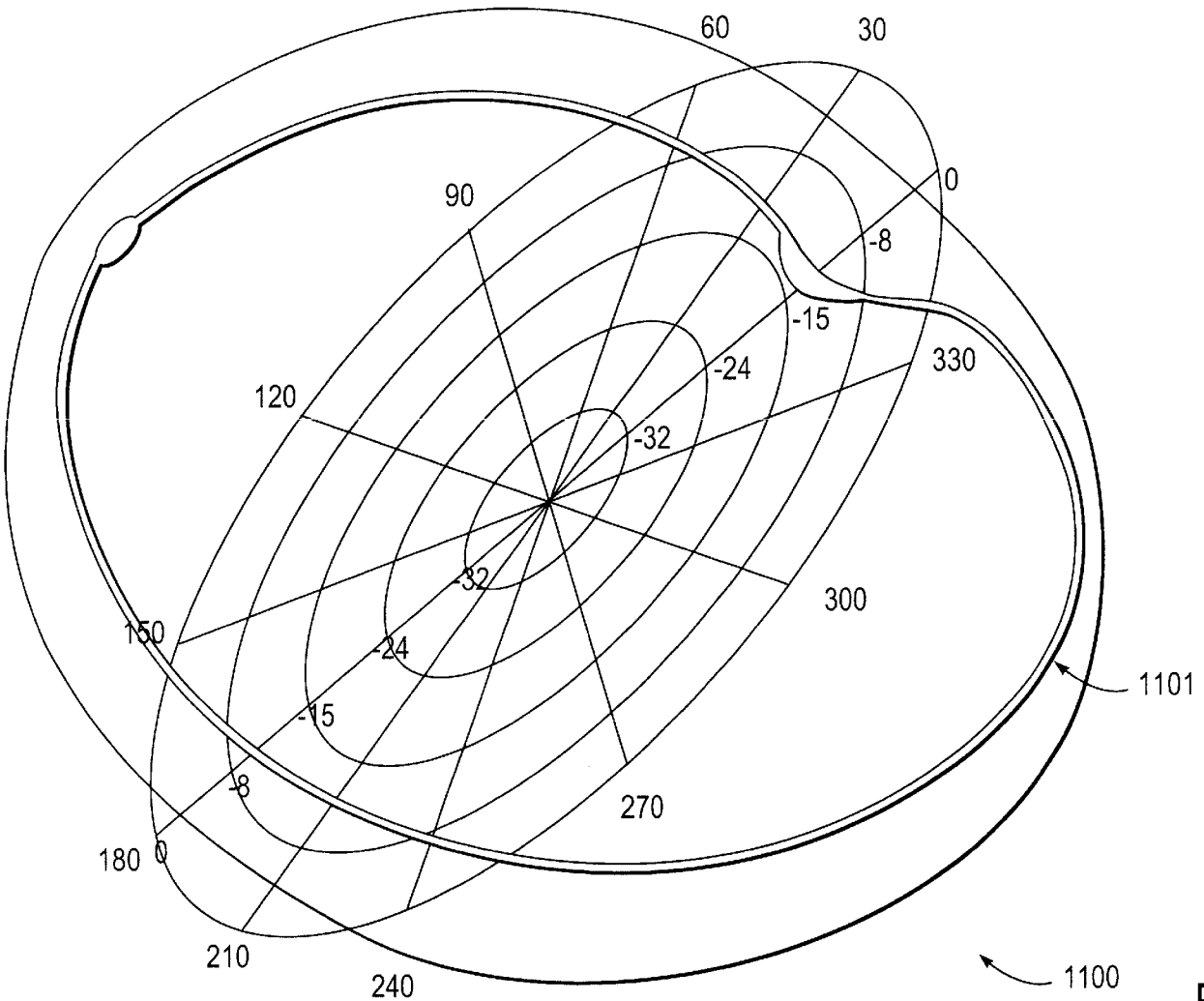
FIG. 11 illustrates the radiation pattern of a double F antenna according to an embodiment of the present invention.

FIG. 11 illustrates the radiation pattern 1100 of antenna 299. Thus, in free space, antenna 299 radiation graph 1101 is consistent with a −20 dBm loss of energy, due to imperfect isolation between ports 203 and 204. The radiation pattern 1100 is at 2.45 GHz although other frequencies are also within the scope of the present design.

Throughout the foregoing description, for the purpose of explanation, numerous specific details were set forth in order to provide a thorough understanding of the invention. It will be apparent, however, to one skilled in the art that the invention may be practiced without some of these specific details. For example, while the embodiments described above focused on the Bluetooth protocol, many of the underlying principles of the invention may practiced using various other types of wireless and terrestrial protocols. Accordingly, the scope and spirit of the invention should be judged in terms of the claims which follow.

What is claimed is:

1. An antenna, comprising:

a conductive member having a center between a first end and a second end of the member;

a first port connected perpendicularly to the conductive member between the center and the first end, wherein the first port receives broadcast signals from the conductive member;

a second port connected perpendicularly to the conductive member between the center and the second end, wherein the second port transmits broadcast signals to the conductive member; and a ground port connected perpendicularly to the conductive member, wherein the ground port is connected to the center;

wherein the antenna is disposed within a dielectric substrate of an integrated circuit.

2. The antenna of claim 1, wherein the antenna is symmetric about the center of the conductive member.

3. The antenna of claim 1, wherein the first port and the second port are substantially electrically isolated.

4. The antenna of claim 2, wherein the member, the first port, the second port and the ground port are on a common planar surface within the integrated circuit.

5. The antenna of claim 2, wherein the integrated circuit is used in a wireless device.

6. The antenna of claim 1, wherein the antenna is made of copper.

7. An integrated circuit, comprising:

a top ground plane;

a dielectric substrate connected to the top ground plane;

a transceiver configured to receive and transmit communication signals;

an antenna connected to the transceiver, wherein the antenna comprises:

a conductive member having a center between a first end and a second end of the member;

a first port connected perpendicularly to the conductive member between the center and the first end;

a second port connected perpendicularly to the conductive member between the center and the second end; and a ground port connected perpendicularly to the conductive member, wherein the ground port is connected to the center; and an interface connected to the transceiver configured to communicate outside the integrated circuit.

8. The integrated circuit as in claim 7, further comprising a bottom ground plane connected to the dielectric substrate.

9. The integrated circuit of claim 7, wherein the first port and the second port are substantially electrically isolated.

10. The integrated circuit of claim 7, wherein the member, the first port, the second port and the ground port are on a common planar surface within the integrated circuit.

11. The integrated circuit of claim 7, wherein the integrated circuit is used in a wireless device.

12. The integrated circuit of claim 11, wherein the wireless device is a Bluetooth device operating at 2.45 GHz.

13. The integrated circuit of claim 7, wherein the first port receives signals from the conductive member, and wherein the second port transmits signals to the conductive member.

14. The integrated circuit of claim 7, wherein the antenna is made of copper.

15. The integrated circuit of claim 7, wherein the antenna is symmetric about the center of the conductive member.

16. An antenna, comprising:

a conductive member having a center between a first end and a second end of the member;

a first port connected perpendicularly to the conductive member between the center and the first end;

a second port connected perpendicularly to the conductive member between the center and the second end; and a ground port connected perpendicularly to the conductive member, wherein the ground port is connected to the center;

wherein the antenna is disposed within a dielectric substrate of an integrated circuit.

17. The antenna of claim 16, wherein:

the first port receives signals from the conductive member; and the second port transmits signals to the conductive member.

18. An integrated circuit, comprising:

a transceiver;

an antenna coupled to the transceiver, wherein the antenna comprises:

a conductive member having a center between a first end and a second end of the member;

a first port connected perpendicularly to the conductive member between the center and the first end, wherein the first port receives broadcast signals from the conductive member;

a second port connected perpendicularly to the conductive member between the center and the second end, wherein the second port transmits broadcast signals to the conductive member; and a ground port connected perpendicularly to the conductive member, wherein the ground port is connected to the center; and an interface coupled to the transceiver.

19. The integrated circuit of claim 18, wherein the integrated circuit is used in a wireless device.

20. The integrated circuit of claim 18, wherein:

the transceiver is configured to receive and transmit the signals; and the interface is configured to communicate the signals to components communicatively coupled to the integrated circuit.

* * * * *